US006009585A

United States Patent [19]

Middleton

[11] Patent Number: 6,009,585

[45] Date of Patent: Jan. 4, 2000

[54] METHOD AND APPARATUS FOR WASHING SHOP CLOTHS

[76] Inventor: Richard G Middleton, 211 Dove Ridge Rd., Columbia, S.C. 29223

[21] Appl. No.: 09/158,655

[22] Filed: Sep. 22, 1998

Related U.S. Application Data

[60] Provisional application No. 60/059,761, Sep. 23, 1997.

[51] Int. Cl.[7] ..... D06F 39/04; D06F 39/08

[52] U.S. Cl. ..... 8/158; 68/18 R; 68/18 F; 68/207; 68/208; 68/902

[58] Field of Search ..... 8/158; 68/207, 68/208, 18 R, 18 C, 18 F, 902

[56] References Cited

U.S. PATENT DOCUMENTS

| | | | |
|---|---|---|---|
| 1,537,842 | 5/1925 | McCarty et al. | 68/207 |
| 2,146,262 | 2/1939 | Johnson | 68/207 X |
| 3,775,053 | 11/1973 | Wisdom . | |
| 4,012,194 | 3/1977 | Maffei . | |
| 4,441,340 | 4/1984 | Kaplan . | |
| 4,912,793 | 4/1990 | Hagiwara . | |
| 4,969,926 | 11/1990 | Sewter et al. . | |
| 5,097,556 | 3/1992 | Engel et al. . | |
| 5,222,267 | 6/1993 | Fierro . | |
| 5,309,587 | 5/1994 | Fierro . | |
| 5,582,650 | 12/1996 | Simons . | |
| 5,732,362 | 3/1998 | Izumida et al. . | |
| 5,787,537 | 8/1998 | Mannillo . | |
| 5,937,675 | 8/1999 | Stucker | 68/18 R |

FOREIGN PATENT DOCUMENTS

| | | | |
|---|---|---|---|
| 2151263 | 7/1985 | United Kingdom | 68/18 R |

*Primary Examiner*—Philip R. Coe
*Attorney, Agent, or Firm*—Michael A Mann; Nexsen Pruet Jacobs & Pollard LLP

[57] ABSTRACT

An apparatus for washing shop cloths comprises a hot water storage tank, a washer that washes, rinses, centrifuges and dries, and an evaporator for evaporating effluent from the washer. The washer rotates about a horizontal axis when washing, rinsing, drying and centrifuging, but at different speeds depending on whether it is centrifuging or washing, rinsing or drying. In use, the washer is loaded and then the load is centrifuged to remove fluids present in the cloths. The effluent is discharged to the evaporator. Then the load is washed in hot water from the hot water storage tank and biodegradable degreasers and soaps. After draining the washer to the evaporator, the load is centrifuged. The washer undergoes a rinse cycle, draining the rinse water to the water heater through a filter for reuse, and finally a tumble dry cycle.

17 Claims, 2 Drawing Sheets

METHOD AND APPARATUS FOR WASHING SHOP CLOTHS

Applicant claims the benefit of the filing date of Provisional Patent Application 60/059,761, filed on Sep. 23, 1997, which is incorporated herein by reference.

FIELD OF THE INVENTION

The present invention relates to industrial laundering. In particular, the present invention relates to washing oily, dirty shop cloths.

BACKGROUND OF THE INVENTION

In manufacturing and industrial plants, especially machine shops, cotton and cotton-blend cloths are used to wipe hands and parts that are oily and dirty. The cloths, as a result, become contaminated with lubricants, dirt and metal particles. These cloths are reusable if cleaned.

In many large plants, hundreds and perhaps thousands of cloths are used every day. Cleaning them is an important task and one that should be done in such a way that it generates as little hazardous waste as possible.

Therefore, there is a need for an effective method and apparatus for cleaning shop cloths and other cotton and cotton-blend cloths.

SUMMARY OF THE INVENTION

According to its major aspects and broadly stated, the invention is a method and apparatus for cleaning shop cloths. The apparatus has three major components: a hot water storage tank, a washer that washes, rinses, centrifuges and dries, and an evaporator. The hot water storage tank supplies hot water for washing and rinsing to the washer. The evaporator evaporates dirty wash water to leave minimal residue for disposal. The washer/rinser/centrifuger/dryer rotates about a horizontal axis at different speeds for centrifuging and for washing, rinsing, and drying. Rinse water is returned to the hot water tank where it is filtered and then stored for reuse.

The orientation of the washer is an important feature of the present invention. The washer rotates about a horizontal axis so that during rinsing, drying and washing, the cloths tumble. Tumbling assures that they wash cleaner and dry more quickly. A horizontal axis of rotation makes centrifuging less stable but at reasonable rotational speed can still be effective. Importantly, all three operations can take place in the same machine, so that transferring the load of cloths to different machines for each operation is not necessary.

Reusing the rinse water is important not only for water heating and water use savings but also to limit the load on the evaporator. By limiting the amount of water the evaporator must evaporate, a smaller evaporator can be used so that the size of the overall unit can be kept smaller.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
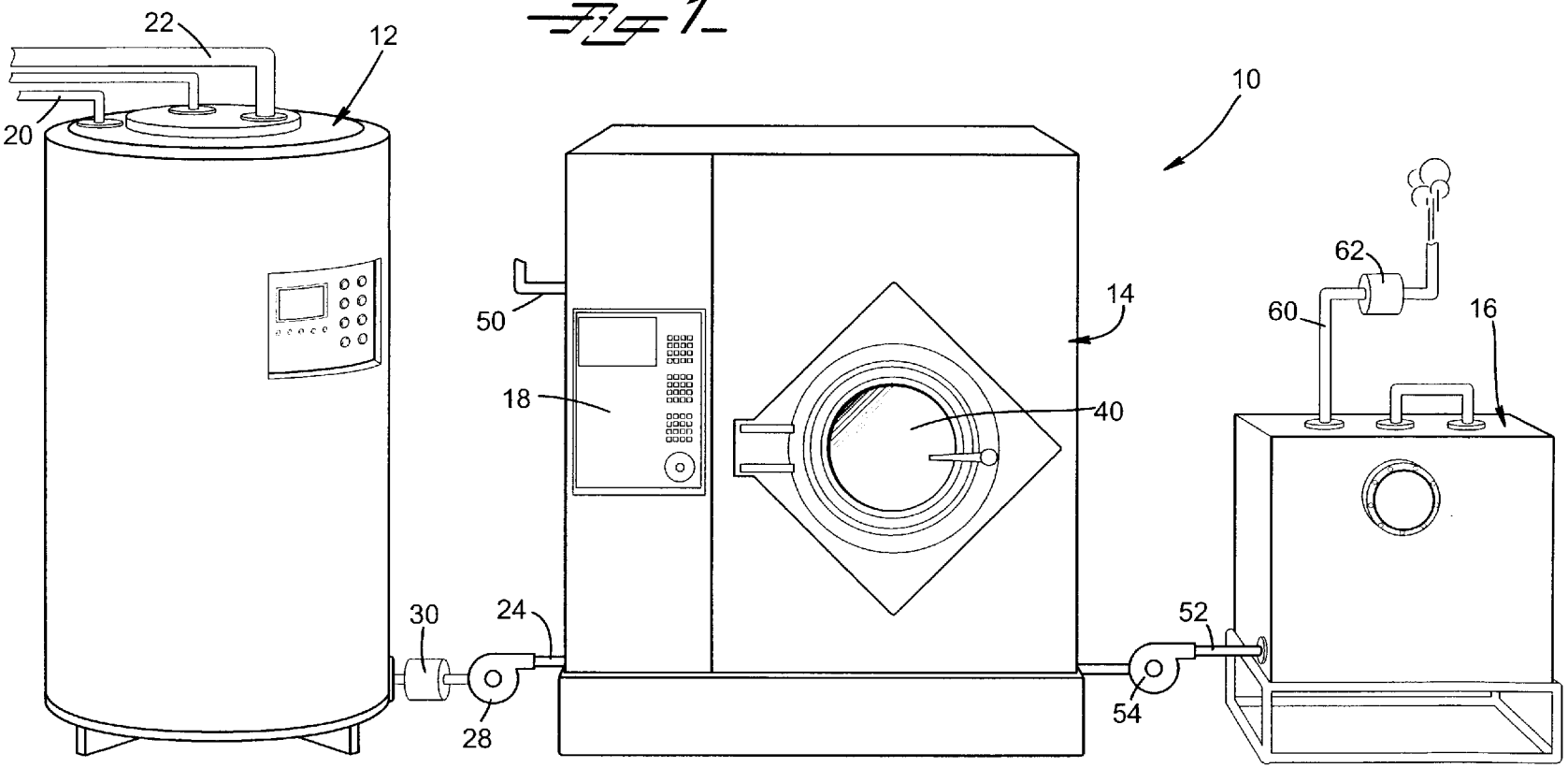
FIG. 1 is a schematic view of a shop cloth cleaning apparatus according to a preferred embodiment of the present invention.
Figure 2:
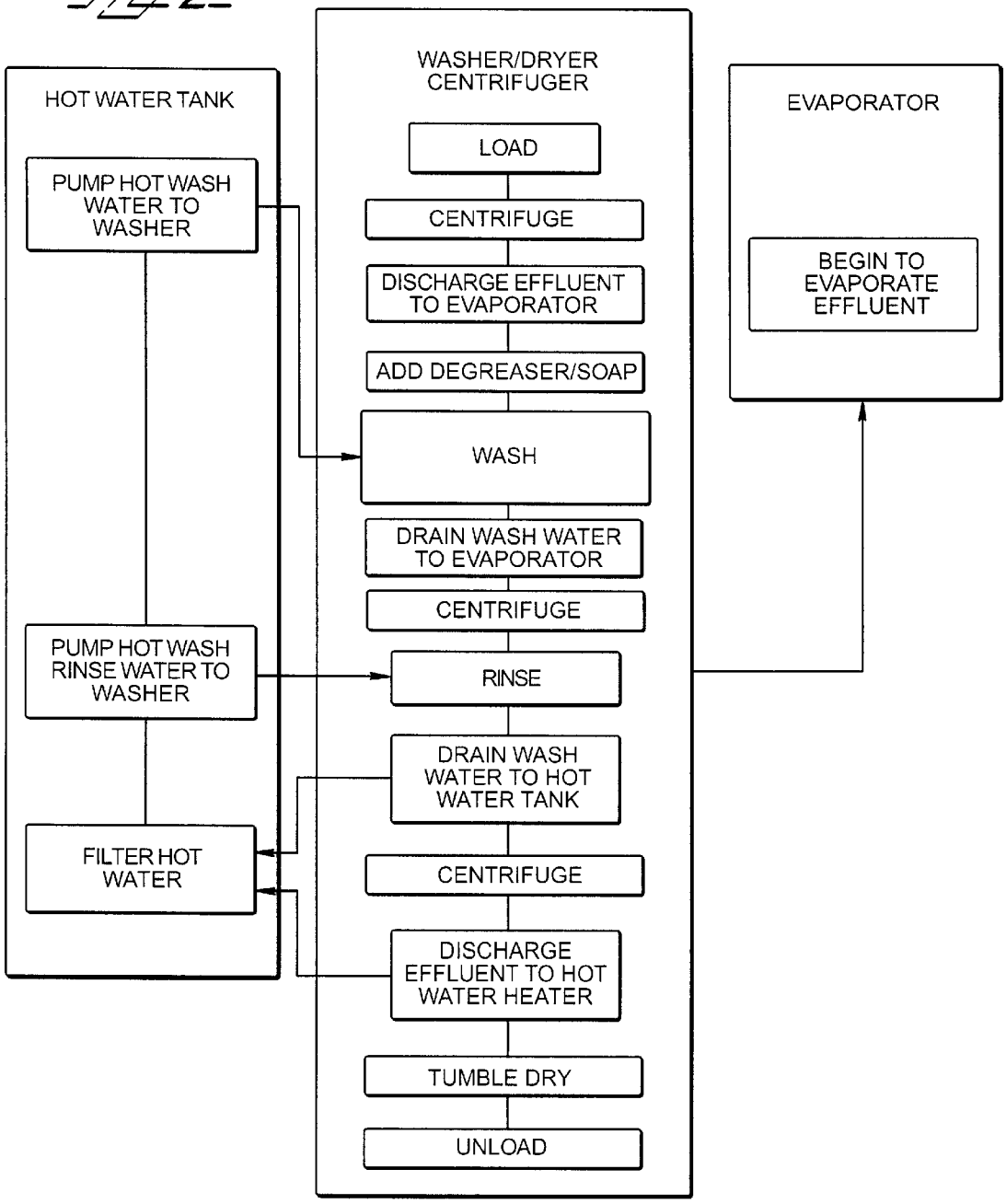
FIG. 2 is a flow chart of the method of cleaning shop cloths according to another preferred embodiment of the present invention.

Referring now to FIG. 1, the present invention shown is an apparatus for cleaning shop cloths. Shop cloths are cotton or cotton-blend cloths typically 12 inches by 14 inches that become contaminated with oils, dirt, and metal particles when they are used in industrial settings. The present apparatus will also clean other types of cotton and cotton-blend cloths contaminated with oils. "Oils" include both petroleum and non-petroleum based solvents and lubricants.

The apparatus, generally indicated by reference number 10, has three main components: a hot water storage tank 12, a washer 14 that washes, rinses, centrifuges and dries, and an evaporator 16. As will be described in more detail below, hot water storage tank 12 supplies wash and rinse water for cleaning cloths. Washer 14 receives a load of cloths and cleans them by removing the oils, dirt and metal particles. Evaporator 16 receives effluents from washer 14 and evaporates the water content of that effluent to reduce the volume of the effluent required for disposal as hazardous waste. All three components can be interconnected and controlled by a control panel 18 as a single apparatus mounted on a skid that can be set into place with a forklift or mounted on a vehicle.

Hot water storage tank 12 is, in the main, a conventional hot water storage tank having the requisite capacity for supplying washer 14 with sufficient water, which is preferably heated to between approximately 140° F. to 160° F. for both washing and rinsing. In a preferred embodiment for an apparatus 10 capable of cleaning one thousand shop cloths in a day, water storage heater has a capacity of seventy-five gallons. Water storage heater is preferably a gas or an electric water heater that is connected to a source 20 of 220 VAC and that contains electrical heating elements for heating the water in tank 12. Hot water storage tank 12 is connected to a source 22 of clean water and is also connected via an outflow and a return line 24 to washer 14. A pump 28 assists in moving water to and from washer 14 through outflow and return line 24. A filter 30 in line 24 prevents particles from being returned to tank 12.

Washer 14 is a conventional industrial washer in many respects. In particular, washer 14 has a drum inside that receives a load of cloths and rotates when washing, rinsing, centrifuging and drying about a horizontal axis rather than a vertical one. All four operations take place in the same drum 40. Washing, rinsing and drying operations take place at slower rotational speeds that assure tumbling of the cloths as they approach the top of the rotating cycle, typically less than 125 RPM, and preferably at rotational speeds comparable to that of dry cleaning machines. Centrifuging takes place at higher rotational speeds, typically 250–400 RPM. Use of washer 14 for washing, rinsing, drying and centrifuging eliminates the need to transfer loads between a centrifuge and a washer. Use of a horizontal axis of rotation assures that cloths tumble during washing, rinsing, and drying.

Washer 14 is in two-way fluid communication with water storage heater 12 through line 24 so that it can receive hot water from water storage heater 12 and can discharge rinse water back to water storage heater 12 after the rinse cycle. Reuse of hot water following rinsing reduces the amount of make-up water needed for a series of loads of cloths and the amount of energy needed to heat the water, since the rinse water has only lost a portion of its heat during use and is still warmer than fresh, make-up water.

Washer 14 contains a source 50 of biodegradable degreasers, detergents and soaps for removing the oils from cloths. These are metered into washer 14 as wash water is being added.

Finally, washer 14 discharges effluents other than rinse water to evaporator 16 through outflow line 52. These effluents include any oils or liquids from the initial centrifuging of cloths and the wash water. These are discharged through outflow line 52, assisted by pump 54.

Washer 14, in the example previously given of one thousand cloths/day, would have a thirty-five pound capacity which corresponds to approximately two hundred standard cloths per batch. Five loads of two hundred cloths, each load requiring about one hour to wash, would complete a day, leaving time for water in evaporator 16 to evaporate before the next day has begun.

Evaporator 16 removes water from the effluent received from washer 14, reducing it to a residue that is either a thick paste or a dry material as preferred. Evaporator 16 can be made to shut off automatically using a temperature sensor in its floor, a timer, a level indicator, a conductivity sensor, or other conventional means capable of indicating the substantial absence of moisture.

In the example being used to illustrate an embodiment of the invention capable of processing one thousand cloths per day, evaporator 16 has a capacity of approximately one hundred five gallons and is capable of evaporating fifteen gallons per hour. It will receive upwards of thirty gallons per hour from washer 14.

Evaporator 16 is equipped with a vent 60 having a filter 62 that removes volatile compounds and particulate. As in the case of hot water storage tank 12, evaporator 16 can be powered by gas or electricity, but preferably by the same power source as hot water storage tank.

In use, a load of cloths are placed in washer 14, its door is closed and latched. At control panel 18, the cycle is initiated. For partial loads, the cycle time can be reduced, but for a full load, a standard cycle is selected. The cycle begins by a short, perhaps two to three minute centrifuging of cloths at 250 to 400 RPM to remove any excess, easily removable liquids. The effluent is discharged to evaporator 16.

Then pump 28 pumps hot water from water storage heater 12 to washer 14 as the degreasers and other cleaners are metered to washer 14. For the present example of two hundred cloths in a batch, thirty gallons of hot water are sufficient. The type of oils and solvents that contaminate cloths and the hardness of the water may require an adjustment of the types, concentrations, quantities and mixes of degreasers, soaps, detergents, etc. that are used to remove oils and solvents from cloths. However, degreasers, etc. are most preferably biodegradable.

Washer proceeds through its wash cycle, which may last eight to ten minutes at the slower rotational speeds for washing. At the end of the wash, washer 14 is drained and spun at centrifuge speeds for typically two to four minutes. The drainage and effluent from centrifuging are discharged to evaporator 16 by pump 54. The receipt of wash water by evaporator 16 causes evaporator 16 to heat in order to begin evaporating.

After the wash cycle, a rinse cycle is performed. Again, about thirty gallons of hot water, for a two hundred cloth batch, from hot water storage tank 12 are pumped by pump 28 to washer 14; however, this time hot water is used alone—no degreasers, etc. are used. After eight to ten minutes for rinsing at the slower rotational speeds, rinse water is drained from washer 14 and then centrifuged out of cloths for two to four minutes. This time, however, the rinse water is not pumped by pump 54 to evaporator 16 but is pumped by pump 28 to hot water storage tank 12 for reuse. Filter 30 removes particulate from the rinse water. Washer 14 then tumble dries the cloths.

Evaporator 16 evaporates moisture from the liquid. The moisture is vented through filter 62 and out vent 60. Filter 62 removes volatile chemical compounds and airborne particulate. Filter 62 is preferably an activated carbon filter or a high energy particulate absorber (HEPA) filter, or both in tandem.

It will be apparent to those skilled in the art that many changes and substitutions can be made to the preferred embodiment herein described without departing from the spirit and scope of the present invention as defined by the appended claim.

What is claimed is:

1. An apparatus for washing shop cloths, said apparatus comprising:

(a) a hot water heater;

(b) means for washing and rinsing cloths, said washing and rinsing means being in fluid communication with said hot water heater so that said hot water heater supplies hot water to said washing and rinsing means for washing said cloths, and said washing and rinsing means returns rinse water to said hot water heater; and (c) an evaporator in fluid communication with said washing and rinsing means, said evaporator receiving wash water from said washing and rinsing means and evaporating water from said wash water.

2. The apparatus as recited in claim 1, further comprising a centrifuge for centrifuging said cloths, said centrifuge being in operational connection with said evaporator so that effluent from said centrifuge flows to said evaporator.

3. The apparatus as recited in claim 1, wherein said evaporator has a vent, said apparatus further comprising:

(a) a high energy particulate absorber; and (b) an activated carbon filter, said high energy particulate absorber and said activated carbon filter attached to said vent so that gases released by said evaporator pass through said high energy particulate absorber and said activated carbon filter.

4. The apparatus as recited in claim 1, wherein said washing and rinsing means includes means for drying said cloths.

5. The apparatus as recited in claim 1, wherein said washing and rinsing means includes means for centrifuging said cloths.

6. An apparatus for washing shop cloths, said apparatus comprising:

(a) a hot water heater;

(b) washer means for washing, rinsing and drying cloths, said washer means being in fluid communication with said hot water heater so that said hot water heater supplies hot water to said washer means for washing and rinsing said cloths, and said washer means returns rinse water to said hot water heater;

(c) an evaporator in fluid communication with said washing and rinsing means, said evaporator receiving wash water from said washing and rinsing means and evaporating water from said wash water; and (d) means for pumping said wash water to said evaporator and said rinse water to said hot water heater.

7. The apparatus as recited in claim 6, wherein said washer has a tank that rotates about a horizontal axis when drying said cloths.

8. The apparatus as recited in claim 6, wherein said washer means further comprises a centrifuge for centrifuging liquids from said cloth before washing.

9. The apparatus as recited in claim 6, wherein said washer means further comprises a centrifuge for centrifuging liquids from said cloth before washing, said washer means drying and centrifuging about a horizontal axis.

10. The apparatus as recited in claim 6, wherein said washer means further comprises a centrifuge for centrifuging liquids from said cloth before washing, and wherein said washer means dries by rotating at a speed of up to 125 revolutions per minute and centrifuges at a speed of up to 400 revolutions per minute.

11. The apparatus as recited in claim 6, further comprising a filter positioned between said hot water heater and said washer means so that said filter removes metal particles from said rinse water.

12. The apparatus as recited in claim 6, wherein said evaporator has a vent, said apparatus further comprising:

(a) a high energy particulate absorber; and (b) an activated carbon filter, said high energy particulate absorber and said activated carbon filter attached to said vent so that gases released by said evaporator pass through said high energy particulate absorber and said activated carbon filter.

13. A method for cleaning shop cloths, said method comprising the steps of:

(a) centrifuging said cloths;

(b) pumping effluent from said centrifuging step to an evaporator;

(c) pumping hot water into a washing machine from a hot water heater;

(d) washing said cloths in said washing machine;

(e) pumping wash water from said washing machine to said evaporator;

(f) centrifuging said cloths in said washing machine;

(g) pumping hot water into said washing machine from said hot water heater;

(h) rinsing said cloths in said washing machine;

(i) pumping rinse water from said washing machine to said hot water heater; and (j) evaporating water from said evaporator.

14. The method as recited in claim 13, further comprising the step of drying said cloths, said washing, centrifuging and drying steps done by rotating said cloths in said washing machine about a horizontal axis.

15. The method as recited in claim 13, further comprising the step of filtering metal particulate from said rinse water before it reaches said hot water heater.

16. The method as recited in claim 13, wherein said evaporator has a vent, and said method further comprises the step of filtering gases from said evaporator through a high energy particulate absorber and an activated charcoal filter prior to release from said vent.

17. The method as recited in claim 13, wherein said centrifuging step is done at a speed of not more than 400 revolutions per minute.

* * * * *